US011136161B2

(12) United States Patent
Liu

(10) Patent No.: US 11,136,161 B2
(45) Date of Patent: Oct. 5, 2021

(54) PACKAGING BOX

(71) Applicant: PEGATRON CORPORATION, Taipei (TW)

(72) Inventor: Tsung-Han Liu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/816,840

(22) Filed: Mar. 12, 2020

(65) Prior Publication Data

US 2020/0369431 A1 Nov. 26, 2020

(30) Foreign Application Priority Data

May 22, 2019 (CN) ..... 201920741134.7

(51) Int. Cl.
*B65D 5/10* (2006.01)

(52) U.S. Cl.
CPC ..... *B65D 5/106* (2013.01)

(58) Field of Classification Search
CPC ..... B65D 5/106; B65D 5/10; B65D 5/103; B65D 5/0254; B65D 5/308
USPC ..... 229/155, 157, 185, 156, 150, 122.32, 229/142, 153; 206/509; 493/183
See application file for complete search history.

(56) References Cited

U.S. PATENT DOCUMENTS 7,900,816 B2 * 3/2011 Kastanek ..... B65D 5/064 229/117.13
8,820,620 B2 * 9/2014 Vincent ..... B65D 5/38 229/122
9,566,756 B2 * 2/2017 Brundage ..... B31B 50/60
9,611,072 B2 * 4/2017 Sharon ..... B65D 21/0212
9,878,818 B2 * 1/2018 Grajales ..... B65D 5/6608
9,884,712 B2 * 2/2018 Coogan ..... B65D 5/746
(Continued)

FOREIGN PATENT DOCUMENTS

CA 1237404 5/1988
CN 207956321 10/2018
CN 108820436 11/2018
(Continued)

OTHER PUBLICATIONS

"Search Report of Europe Counterpart Application", dated Jun. 9, 2020, p. 1-p. 7.
(Continued)

*Primary Examiner* — Christopher R Demeree
(74) *Attorney, Agent, or Firm* — J.C. Patents

(57) ABSTRACT

A packaging box includes a body, a first and a second bottom plate. The body has an accommodating space and a bottom opening and includes a first and a second side plate opposite to each other. The first bottom plate is foldably connected to the first side plate and has a first bottom part for covering the bottom opening and a main inserting part foldably connected to the first bottom part. The first bottom part has a slit. When the first bottom part covers the bottom opening, the main inserting part is inserted into the bottom opening. The second bottom plate is foldably connected to the second side plate and includes a second bottom part and a tongue. The second bottom part is superposed on the first bottom part. The tongue is inserted into the slit, so that the second bottom plate is detachably fixed to the first bottom plate.

8 Claims, 3 Drawing Sheets

(56) References Cited

U.S. PATENT DOCUMENTS

| | | | | |
|---|---|---|---|---|
| 10,099,853 | B2 * | 10/2018 | Miller | B65F 1/00 |
| 10,239,652 | B2 * | 3/2019 | Vanderhulst | B65D 5/541 |

FOREIGN PATENT DOCUMENTS

| | | |
|---|---|---|
| KR | 20090000346 | 1/2009 |
| KR | 20160004177 | 12/2016 |
| KR | 20170091539 | 8/2017 |
| TW | 201343492 | 11/2013 |

OTHER PUBLICATIONS

"Office Action of Korea Counterpart Application" with English translation thereof, dated Jul. 22, 2021, p. 1-p. 10.

* cited by examiner

PACKAGING BOX

CROSS-REFERENCE TO RELATED APPLICATION

This application claims the priority benefit of China application serial no. 201920741134.7, filed on May 22, 2019. The entirety of the above-mentioned patent application is hereby incorporated by reference herein and made a part of this specification.

BACKGROUND

Technical Field

The present disclosure relates to a packaging box, and in particular, to a packaging box with a firmly fixed bottom.

Related Art

In general, for a common firm packaging box, a bottom is generally fixed using a tape after assembling. However, this method has certain restrictions on the weight of an object carried in the packaging box. If the object is overweight, it is very likely to cause damage to the bottom of the packaging box, and the object is even damaged as a result of falling out. In addition, generally, fixing the bottom using a tap cannot be performed by a machine. If a large quantity of packaging boxes need to be assembled for a manufacturer to load goods, a lot of manpower and labor are spent to adhere the bottom of the packaging box by using the tap. Therefore, it is an important issue to speed up packaging and improve fixity of a packaging box.

SUMMARY

The present disclosure provides a packaging box. A bottom of the packaging box may be firmly assembled directly through a structure of the packaging box, so that an assembling process is more convenient and requires fewer costs.

The packaging box of the present disclosure includes a body, a first bottom plate, and a second bottom plate. The body has an accommodating space and a bottom opening communicating with the accommodating space and includes a first side plate and a second side plate that are opposite. The first bottom plate is foldably connected to the first side plate and has a first bottom part for covering the bottom opening and a main inserting part foldably connected to the first bottom part. The first bottom part has a slit. When the first bottom part covers the bottom opening, the main inserting part is adapted to be inserted into the bottom opening to contact with the second side plate. The second bottom plate is foldably connected to the second side plate and includes a second bottom part and a tongue extending from the second bottom part. The second bottom part is adapted to be superposed on a portion of the first bottom part. The tongue is adapted to be inserted into the slit, so that the second bottom plate is detachably fixed to the first bottom plate.

According to an embodiment of the present disclosure, the first bottom part has a first edge and a second edge that are opposite, the first edge being connected to the first side plate, the second edge being connected to the main inserting part, and a distance between the slit and the first edge being greater than or equal to a distance between the slit and the second edge.

According to an embodiment of the present disclosure, a width of the second bottom part is a half of a distance between the first side plate and the second side plate.

According to an embodiment of the present disclosure, the body includes a third side plate and a fourth side plate that are opposite, and the packaging box further includes two side bottom plates that are respectively foldably connected to the third side plate and the fourth side plate, the two side bottom plates being adapted to be superposed on a portion of the first bottom part, and the second bottom part being adapted to be superposed on a portion of the first bottom part and portions of the two side bottom plates.

According to an embodiment of the present disclosure, one of the two side bottom plates covers a portion of the slit when superposed on the first bottom part.

According to an embodiment of the present disclosure, a length of the slit is the same as a length of the tongue.

According to an embodiment of the present disclosure, the first bottom part has a third edge and a fourth edge that are opposite, and the first bottom plate further includes two secondary inserting parts respectively foldably connected to the third edge and the fourth edge of the first bottom part, when the first bottom part covers the bottom opening, the two secondary inserting parts being adapted to be inserted into the bottom opening to contact with the third side plate and the fourth side plate.

According to an embodiment of the present disclosure, a shape of a portion of the secondary inserting part is complementary to a shape of a portion of a corresponding side bottom plate.

According to an embodiment of the present disclosure, the slit is completely exposed when the two side bottom plates are superposed on the first bottom part.

Based on the foregoing, the first bottom plate of the packaging box in the embodiments of the present disclosure has the first bottom part and the main inserting part foldably connected to the first bottom part. When the first bottom plate covers the bottom opening, the main inserting part is inserted into the bottom opening to contact with the second side plate, so as to provide good fixity. In addition, the first bottom plate has a slit, and the second bottom plate has a tongue corresponding to the slit. When the second bottom plate is superposed on the first bottom plate, the tongue is inserted into the corresponding slit, so that the first bottom plate and the second bottom plate are fixed to each other. Therefore, the first bottom plate and the second bottom plate of the present disclosure may be directly assembled and cover the bottom opening, and can carry an object more stably.

To make the features and advantages of the present disclosure more comprehensible, a detailed description is made below with reference to the accompanying drawings by using embodiments.

DETAILED DESCRIPTION

Figure 1:
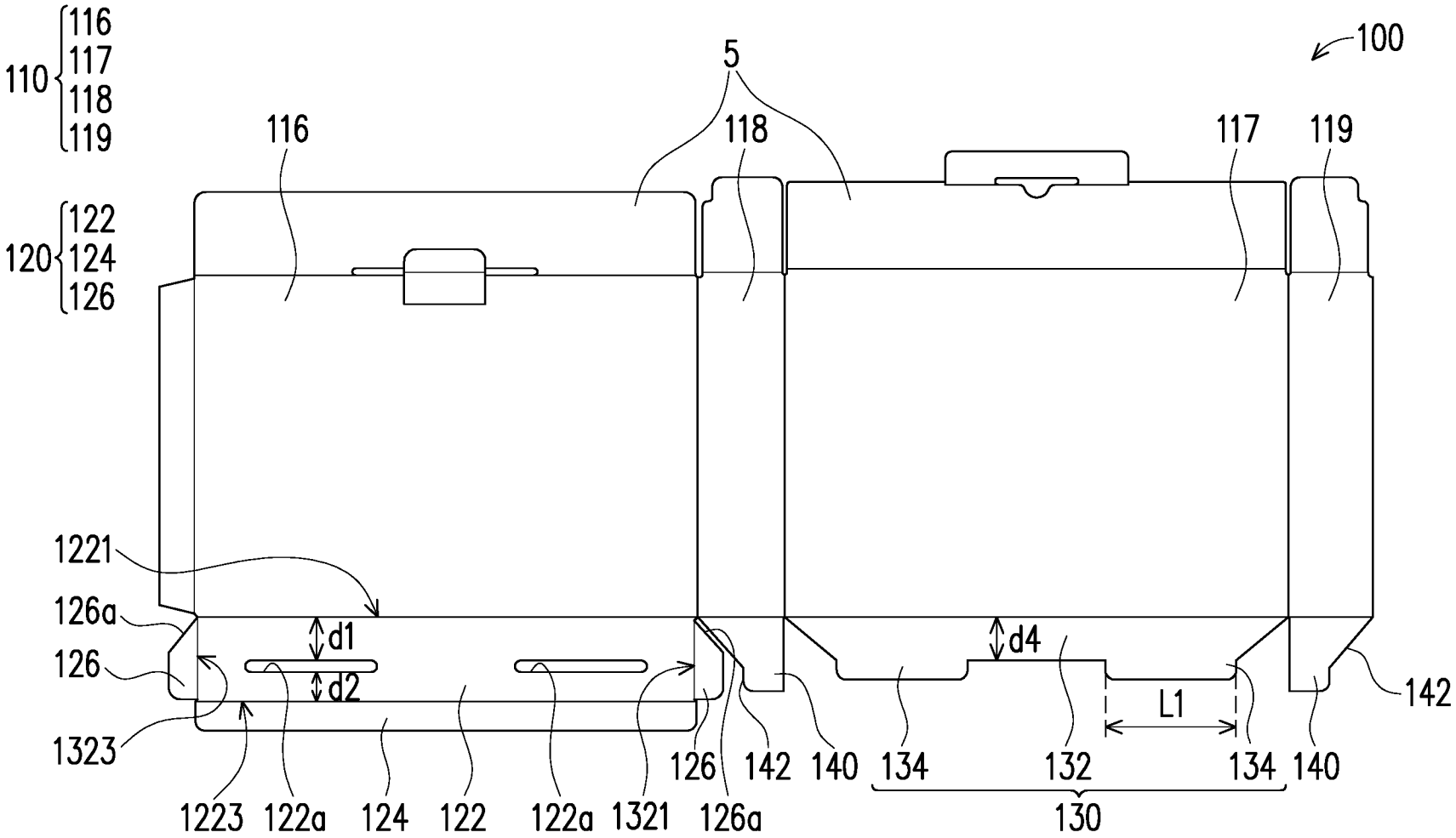
FIG. 1 is a schematic planar view of a packaging box in an unfolded state according to an embodiment of the present disclosure.
Figure 2A:
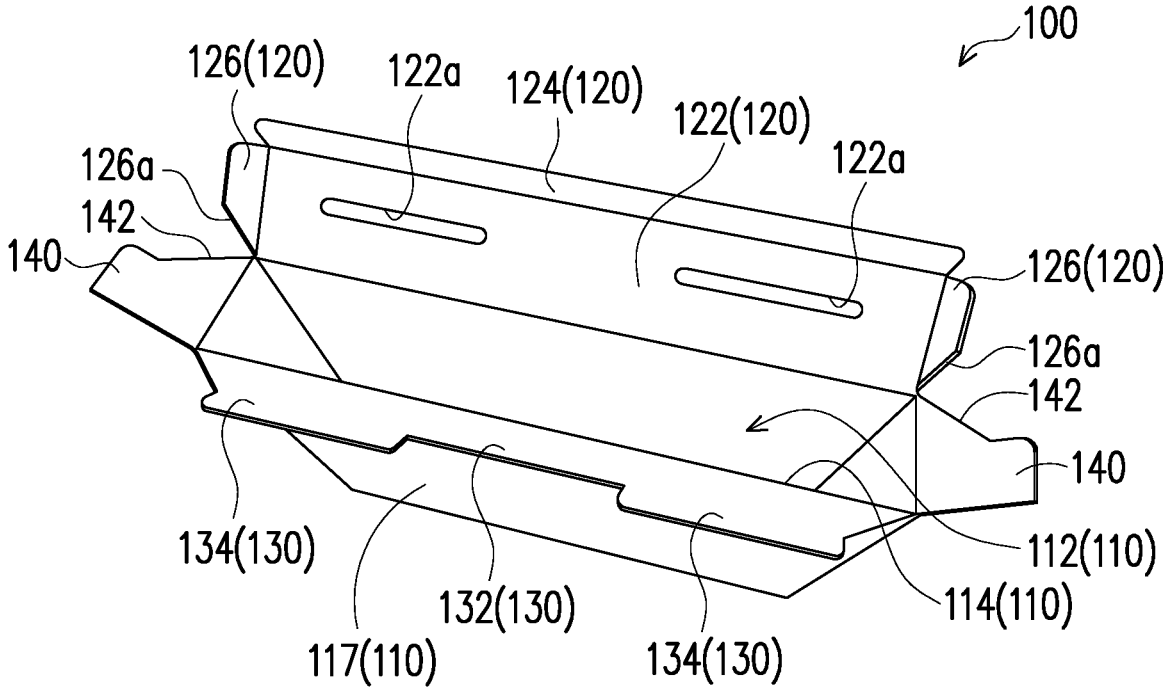
FIG. 2A to FIG. 2C are schematic views of a process of folding a bottom structure of the packaging box in FIG. 1.
Figure 2B:
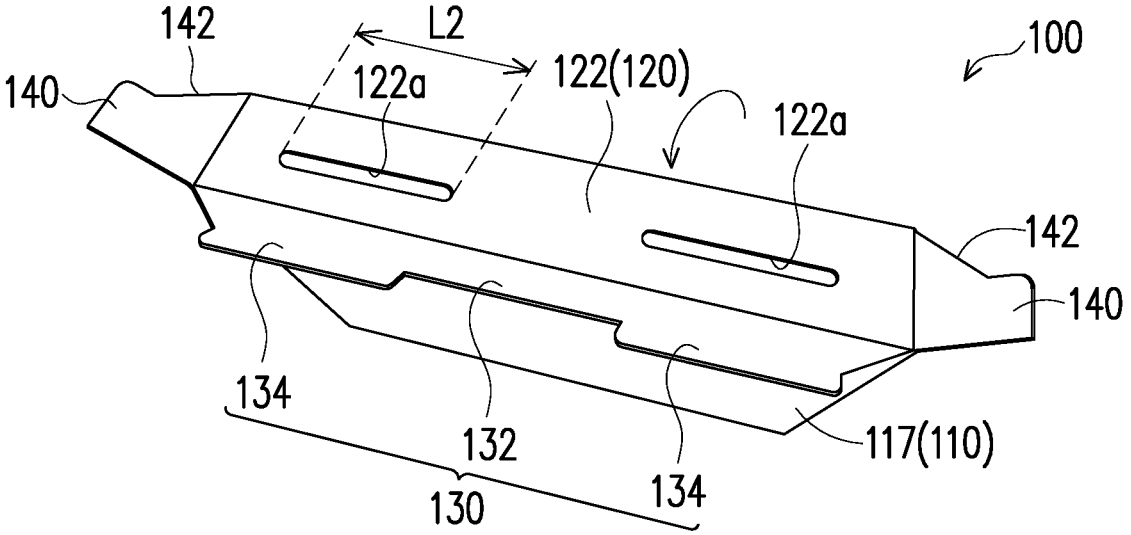
Figure 2C:
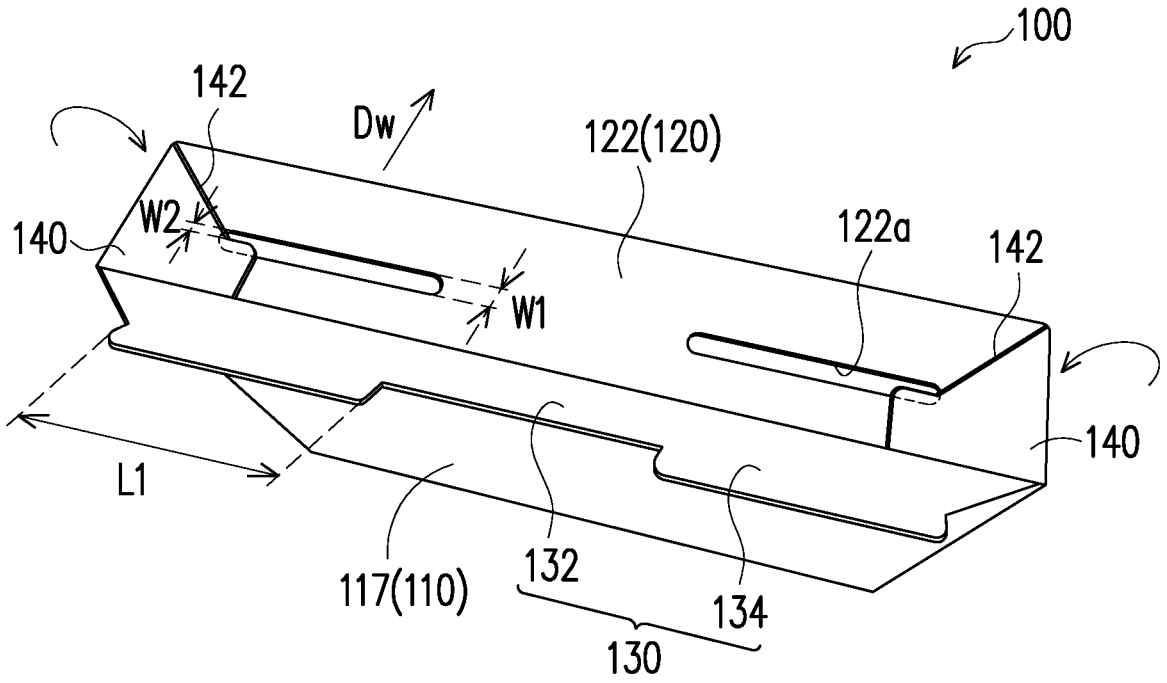
Figure 2D:
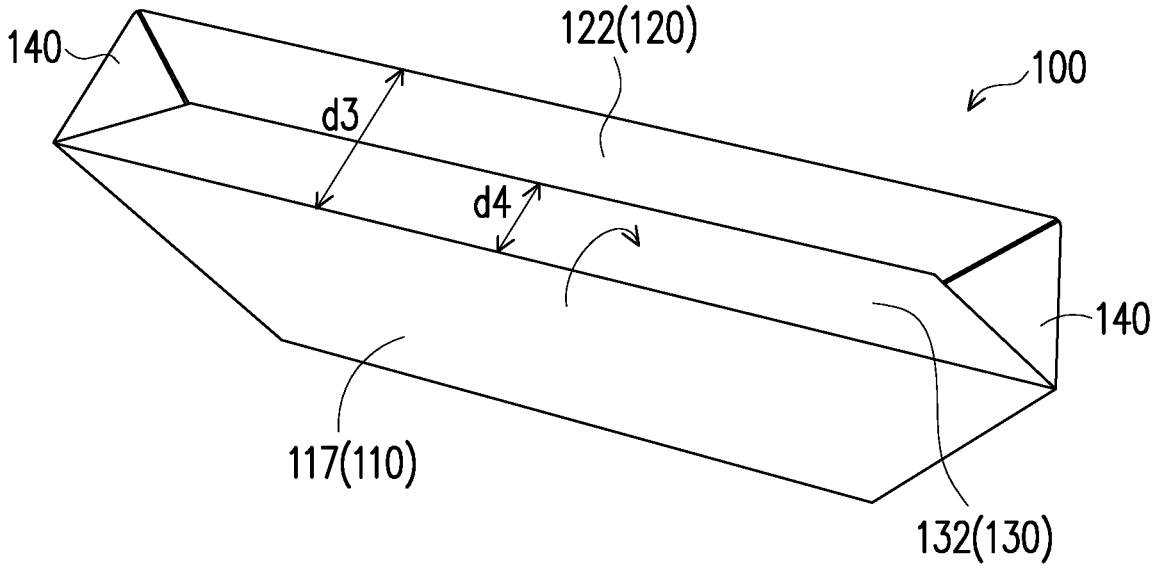
FIG. 2D is a schematic three-dimensional view of the assembled packaging box in FIG. 1.

FIG. 1 is a schematic planar view of a packaging box in an unfolded state according to an embodiment of the present disclosure. FIG. 2A to FIG. 2C are schematic views of a process of folding a bottom structure of the packaging box in FIG. 1. FIG. 2D is a schematic three-dimensional view of the assembled packaging box in FIG. 1. Referring to FIG. 1 to FIG. 2D, in this embodiment, a packaging box 100 may be changed from an unfolded state in FIG. 1 to an assembled state in FIG. 2D through folding. It should be noted that, in order to clearly show a bottom structure of the packaging box of the present disclosure, the packaging box 100 is shown in FIG. 2A to FIG. 2D upside down. In addition, a detailed structure of a cover plate 5 shown in FIG. 1 is merely an example, and a form of the cover plate 5 of the packaging box is not limited in the present disclosure.

In addition, in this embodiment, the packaging box 100 is made of, for example, a cardboard, and therefore has a hard texture and a light weight. Certainly, usage, an assembling manner, and a material of the packaging box 100 are not limited in the present disclosure. A process of folding the bottom structure of the packaging box 100 of the present disclosure is described in detail below.

Referring to FIG. 1 and FIG. 2A, in this embodiment, the packaging box 100 includes a body 110, a first bottom plate 120, and a second bottom plate 130. In particular, a body 110 includes a first side plate 116 and a second side plate 117. The first bottom plate 120 of the packaging box 100 is foldably connected to the first side plate 116, and the second bottom plate 130 of the packaging box is foldably connected to the second side plate 117. The body 110 has an accommodating space 112 and a bottom opening 114 communicating with the accommodating space 112.

In this embodiment, the first bottom plate 120 has a first bottom part 122 for covering the bottom opening 114 and a main inserting part 124 foldably connected to the first bottom part 122. The first bottom part 122 in this embodiment has a first edge 1221 and a second edge 1223 that are opposite. The first edge 1221 is connected to the first side plate 116, and the second edge 1223 is connected to the main inserting part 124.

As shown in FIG. 2B, when the first bottom part 122 covers the bottom opening 114, the main inserting part 124 is inserted into the bottom opening 114 to contact with the second side plate 117. In this way, the first bottom plate 120 may maintain a distance between the first side plate 116 and the second side plate 117 using the first bottom part 122 between the first side plate 116 and the second side plate 117. In addition, the first bottom plate 120 may further abut against the second side plate 117 using the main inserting part 124, so that there is friction between the first bottom plate 120 and the second side plate 117, thereby providing first fixity for the bottom structure.

In addition, in this embodiment, the first bottom part 122 has a third edge 1321 (shown in FIG. 1) and a fourth edge 1323 (shown in FIG. 1) that are opposite. The first bottom plate 120 may further selectively includes two secondary inserting parts 126. The two secondary inserting parts 126 are respectively foldably connected to the third edge 1321 and the fourth edge 1323 of the first bottom part 122. In addition, the body 110 further includes a third side plate 118 and a fourth side plate 119 that are opposite. When the first bottom part 122 covers the bottom opening 114, the two secondary inserting parts 126 are inserted into the bottom opening 114 to contact with the third side plate 118 and the fourth side plate 119.

Similarly, the first bottom plate 120 may abut against the third side plate 118 and the fourth side plate 119 using the two secondary inserting parts 126, so that there is friction among the first bottom plate 120, the third side plate 118, and the fourth side plate 119, thereby providing second fixity for the bottom structure.

In addition, the packaging box 100 further includes two side bottom plates 140. The two side bottom plates 140 are respectively foldably connected to the third side plate 118 and the fourth side plate 119. As shown in FIG. 2B and FIG. 2C, the two side bottom plates 140 of the packaging box 100 are superposed on the first bottom part 122, and the two side bottom plates 140 respectively cover a portion of a corresponding slit 122*a*.

As shown in FIG. 2D, the second bottom part 132 is then superposed on a portion of the first bottom part 122 and a portion of the two side bottom plates 140. In other words, the side bottom plates 140 are disposed between the first bottom plate 120 and the second bottom plate 130.

Referring to FIG. 2B to FIG. 2D, in this embodiment, the second bottom plate 130 has a second bottom part 132 and a tongue 134 extending from the second bottom part 132. There are, for example, two tongues 134, but the present disclosure is not limited thereto. The first bottom part 122 of the first bottom plate 120 has a slit 122*a*. There are, for example, two slits 122*a*, but the present disclosure is not limited thereto. In addition, in this embodiment, a length L1 of the tongue 134 is the same as a length L2 of the slit 122*a*. Certainly, the quantity of slits 122*a*, the quantity of tongues 134, the length L2 of the slit 122*a*, and the length L1 of the tongue 134 are not limited in other embodiments of the present disclosure.

As shown in FIG. 2D, the tongue 134 of the second bottom plate 130 is adapted to be inserted into the slit 122*a* of the first bottom plate 120 to complete assembling of the packaging box 100.

Referring back to FIG. 2B and FIG. 2C, it should be noted that, in this embodiment, when the two side bottom plates 140 are superposed on the first bottom part 122, corresponding slits 122*a* are respectively partially covered in a width direction Dw, so that the slit 122*a* is exposed by a smaller width W2. In other words, the width W2 by which the slit 122*a* is exposed is less than an original width W1 of the slit 122*a*. In this way, the tongue 134 may be unlikely to be pulled out after inserted into the slit 122*a*.

In addition, in another embodiment not shown, when the two side bottom plates 140 are superposed on the first bottom part 122, the slits 122*a* may also be completely exposed from the two side bottom plates 140, but the present disclosure is not limited thereto.

Based on the design, when the tongue 134 needs to be inserted into the slit 122*a*, the tongue 134 first pushes the two side bottom plates 140 to expose the portion of the slit 122*a* that is originally covered by the side bottom plates 140, so as to insert the tongue piece 134 into the slit 122*a*. Then, the side plate 140 returns to an original position to abut against the tongue 134, so that the tongue 134 is more firmly fixed in the slit 122*a*, thereby providing third fixity for the bottom structure. Therefore, compared to an existing packaging box for which a lot of time and manpower need to be spent to adhere a bottom using a tape, the bottom structure of the packaging box 100 in this embodiment may not require additional fixing materials such as a tape, a glue, or a plastic rope, so that time costs and required manpower may be reduced for factory personnel.

In addition, referring back to FIG. 1 and FIG. 2A, in this embodiment, the secondary inserting part 126 of the first bottom plate 120 has a first recess 126*a* at a portion close to a corresponding side bottom plate 140, and the side bottom plate 140 has a second recess 142 at a portion close to a corresponding secondary inserting part 126. Based on the design, a shape of a portion of the secondary inserting part 126 is complementary to a shape of a portion of the corresponding side bottom plate 140, so that only a single cardboard is required for manufacturing, thereby saving materials. In addition, during assembling of the packaging box 100 performed by packaging personnel, the secondary inserting part 126 of the first bottom plate 120 and the side plate 140 do not interfere with each other, so that an assembling time is not affected and no damage is caused to the packaging box 100.

In addition, as shown in FIG. 1, in this embodiment, an edge of the slit 122*a* close to the first edge 1221 overlaps a center line of the first bottom part 122, so that a distance d1 from the slit 122*a* to the first edge 1221 is slightly greater than a distance d2 from the slit 122*a* to the second edge 1223. Certainly, in other embodiments, the distance d1 may also be equal to the distance d2.

In addition, in order to make an appearance boundary between the first bottom part 122 and the second bottom part 132 to be located at the center line, a width d4 of the second bottom part 132 is a half of a distance d3 (shown in FIG. 2D) between the first side plate 116 and the second side plate 117, but the present disclosure is not limited thereto.

In summary, the first bottom plate of the packaging box in the embodiments of the present disclosure has the first bottom part and the main inserting part foldably connected to the first bottom part. When the first bottom plate covers the bottom opening, the main inserting part is inserted into the bottom opening to contact with the second side plate, so as to provide good fixity. In addition, the first bottom plate has a slit, and the second bottom plate has a tongue corresponding to the slit. When the second bottom plate is superposed on the first bottom plate, the tongue is inserted into the corresponding slit, so that the first bottom plate and the second bottom plate are fixed to each other. Therefore, the first bottom plate and the second bottom plate of the present disclosure may be directly assembled and cover the bottom opening, and can carry an object more stably. In addition, the two side bottom plates of the present disclosure are disposed between the first bottom plate and the second bottom plate, so that the tongue of the second bottom plate and the slit of the first bottom plate are more stably fixed. In this way, the first bottom plate, the second bottom plate, and the side bottom plate of the present disclosure may be firmly fixed to each other without adhesion using a tape, reducing an assembling time and protecting environment.

Although the present disclosure has been described with reference to the above embodiments, the embodiments are not intended to limit the present disclosure. A person of ordinary skill in the art may make variations and improvements without departing from the spirit and scope of the present disclosure. Therefore, the protection scope of the present disclosure should be subject to the appended claims.

What is claimed is:

1. A packaging box, comprising:

a body having an accommodating space and a bottom opening communicating with the accommodating space, and comprising a first side plate and a second side plate opposite to each other, and a third side plate and a fourth side plate opposite to each other;

a first bottom plate foldably connected to the first side plate and having a first bottom part for covering the bottom opening, a main inserting part foldably connected to the first bottom part, and two secondary inserting parts, wherein the first bottom part has a slit, a first edge and a second edge opposite to each other, and a third edge and a fourth edge opposite to each other, wherein the two secondary inserting parts are respectively foldably connected to the third edge and the fourth edge of the first bottom part, and when the first bottom part covers the bottom opening, the main inserting part is adapted to be inserted into the bottom opening to contact with the second side plate, and the two secondary inserting parts are adapted to be inserted into the bottom opening to contact with the third side plate and the fourth side plate; and a second bottom plate foldably connected to the second side plate and comprising a second bottom part and a tongue extending from the second bottom part, wherein the second bottom part of the second bottom plate is adapted to be superposed on a portion of the first bottom part, and the tongue is adapted to be inserted into the slit, so that the second bottom plate is detachably fixed to the first bottom plate.

2. The packaging box according to claim 1, wherein the first edge is connected to the first side plate, the second edge is connected to the main inserting part, and a distance between the slit and the first edge is greater than or equal to a distance between the slit and the second edge.

3. The packaging box according to claim 1, wherein a width of the second bottom part is a half of a distance between the first side plate and the second side plate.

4. The packaging box according to claim 1, wherein the packaging box further comprises two side bottom plates respectively foldably connected to the third side plate and the fourth side plate, the two side bottom plates is adapted to be superposed on a portion of the first bottom part, and the second bottom part is adapted to be superposed on a portion of the first bottom part and portions of the two side bottom plates.

5. The packaging box according to claim 4, wherein one of the two side bottom plates covers a portion of the slit when superposed on the first bottom part.

6. The packaging box according to claim 5, wherein a length of the slit is the same as a length of the tongue.

7. The packaging box according to claim 4, wherein a shape of a portion of each secondary inserting part is complementary to a shape of a portion of a corresponding side bottom plate.

8. The packaging box according to claim 4, wherein the slit is completely exposed when the two side bottom plates are superposed on the first bottom part.

* * * * *